United States Patent [19]

Wirz et al.

[11] Patent Number: 5,029,524

[45] Date of Patent: Jul. 9, 1991

[54] SHEET TRANSFER DEVICE FOR A PRINTING MACHINE

[75] Inventors: Arno Wirz, Bammental; Rudi Haupenthal, Epfenbach, both of Fed. Rep. of Germany

[73] Assignee: Heidelberger Druckmaschinen A.G., Heidelberg, Fed. Rep. of Germany

[21] Appl. No.: 492,553

[22] Filed: Mar. 13, 1990

Related U.S. Application Data

[63] Continuation-in-part of Ser. No. 220,981, Jul. 15, 1988, abandoned, which is a continuation of Ser. No. 25,887, Mar. 16, 1987, abandoned.

[30] Foreign Application Priority Data

Mar. 14, 1986 [DE] Fed. Rep. of Germany ..... 3608470

[51] Int. Cl.[5] ..... B41F 21/06; B41F 21/10; B41L 21/08

[52] U.S. Cl. ..... 101/232; 101/410

[58] Field of Search ..... 101/230, 231, 409, 410, 101/411, 246, 232; 271/183, 184, 186, 902, 82, 69, 90, 225

[56] References Cited

U.S. PATENT DOCUMENTS

| | | | |
|---|---|---|---|
| 3,992,993 | 11/1976 | Kuhn et al. | 101/232 |
| 4,370,928 | 2/1983 | Weisbach et al. | 101/410 |
| 4,378,734 | 4/1983 | Wirz | 101/230 |
| 4,580,494 | 4/1986 | Becker | 101/230 |

*Primary Examiner*—J. Reed Fisher

*Attorney, Agent, or Firm*—Herbert L. Lerner; Laurence A. Greenberg

[57] ABSTRACT

A sheet transfer device for a printing machine with a transfer drum having a rotational axis, a sheet transfer cylinder located downstream from the transfer drum in a travel direction of a sheet through the printing machine, and cooperating with the transfer drum, and a gripper device on the sheet transfer cylinder for gripping at a take-over location a leading edge of the sheet guided by the transfer drum whereby the sheet is transferred to the sheet transfer cylinder includes a sucker arrangement including suction elements disposed on the transfer drum in vicinity of a trailing edge of the sheet guided by the transfer drum, the suction elements, in a starting position thereof, being flush with the periphery of the transfer drum, a suction-air control device actuable for supplying suction air to the suction elements so that suction contact may be made between the suction elements and the sheet, a device for articulatingly linking the suction elements to the transfer drum so that the suction elements are changeable in position from the starting position thereof in a radial and tangential direction with respect to the transfer drum and beyond the periphery thereof into a swung-out position thereof, and a resilient restoring device for returning the suction elements from the swung-out position thereof to the starting position thereof, the suction-air control device being actuable for continuously applying suction air to the suction elements, after the sheet has been gripped at the take-over location, for at least so long that the transfer drum has turned through a rotary angle which is greater by an angle $\alpha$ than an angle $\alpha$, included by the suction elements, on the one hand, and by the leading edge of the sheet, on the other hand, and having its vertex in the rotational axis of the transfer drum.

11 Claims, 5 Drawing Sheets

SHEET TRANSFER DEVICE FOR A PRINTING MACHINE

Figure 1:
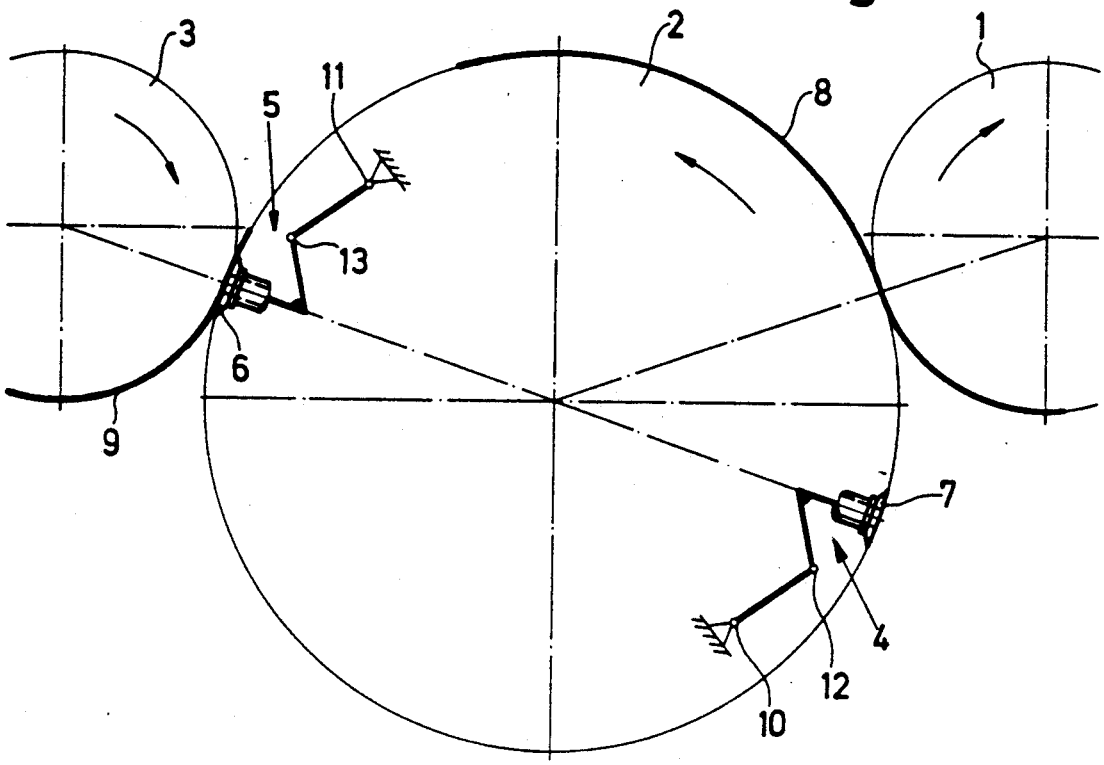

This is a continuation-in-part of application Ser. No. 220,981 filed July 15, 1988, now abandoned, which is a continuation of application Ser. No. 025,887 filed Mar. 16, 1987, now abandoned.

The invention relates to a sheet transfer device for a printing machine with a transfer drum having a rotational axis, a sheet transfer cylinder located downstream from the transfer drum in a travel direction of a sheet through the printing machine, and cooperating with the transfer drum, and a gripper device on the sheet transfer cylinder for gripping at a take-over location a leading edge of the sheet guided by the transfer drum whereby the sheet is transferred to the sheet transfer cylinder. Such a transfer device is known from German Published Non-Prosecuted Application (DE-OS) 34 18 303.

In this regard, during the transfer process, the sheet that has been printed or that is to be printed is held at its end by means of rubber suckers which are connected to a vacuum source. As the sheet is passed on to the succeeding cylinder, the vacuum is turned off in order to release the sheet, the rubber suckers thus letting the sheet go.

It has been shown that, because of residual stresses, especially when the sheet is formed of rather stiff cardboard, the end of the sheet, after release, strikes against the rubber suckers and may damage the latter as a result of cyclic stressing. No vacuum is able to be formed, however, with damaged rubber suckers. To solve this problem, it has been proposed in (DE-OS) 34 18 303 to dispose so-called support plates in the vicinity of the rubber suckers so as to prevent the sheet from striking against the rubber suckers when its end is released. In this case, during transfer, the sheet glides along with its end disposed on the support plates. If the rubber suckers and thus the support plates are not disposed directly at the trailing end of the sheet, but further towards the leading edge of the sheet, however, the trailing edge of the sheet, after being released, may strike against parts of the transfer cylinder and become damaged.

Furthermore, the support plates only provide guidance for the sheet; if the suckers are not disposed directly at the end of the sheet, this may lead to a falling forward of the sheet, which then, owing to its own weight, may slip down on the outer cylindrical surface of the next transfer drum.

It is an object of the invention to provide a sheet transfer device, which ensures a smear-free sheet transfer without any possible damage to the suction elements and the sheet.

It is a further object of the invention to provide a sheet transfer device for transferring sheets in a printing machine from one printing unit to the next wherein, until the sheet is completely accepted by a succeeding transfer cylinder, the sheet is forcibly guided at its end, thereby preventing both damage to the trailing edge of the sheet as well as undefined movements of the sheet.

With the foregoing and other objects in view, there is provided, in accordance with one embodiment of the invention, a sucker arrangement mounted at two fastening points in a swivel plane. In this regard, one of the fastening points is in the form of a simple pivot, while the other fastening point is forcibly guided on a curve i.e. along a curved or cam path. A joint is provided between these two fastening points. The sucker arrangement may be disposed directly i.e. rigidly, at the fastening point which is movable along the curve or cam; this has the advantage that the desired or nominal movement of the suction device can be simulated in simple manner by the shape of the curve or cam.

In order to predetermine the movement of the sucker arrangement, there is proposed in accordance with a further feature of the invention, that the suction force between the sheet and the sucker arrangement be applied for moving the sucker arrangement along the curve or cam path. It is then guided, in effect, by the end of the sheet. In the final phase of the transfer of the sheet from the transfer cylinder to a succeeding cylinder, the arrangement controlled by the sheet is then released from the surface of the sheet. This is effected due to the sheet being pulled off the sucker arrangement in longitudinal direction. Alternatively thereto, it is also possible, at the appropriate time, for the sucker arrangement to be vented by a suction-air control device. This likewise releases the sheet from the transfer drum.

To return the sucker arrangement to the starting position wherein the suction elements are flush with the periphery of the transfer cylinder, in accordance with an additional feature of the invention, spring means are provided for exerting a force on the sucker arrangement so as to ensure a fast reliable return of the sucker arrangement.

Instead of the spring means, or also as an addition to the spring means, in accordance with an added feature of the invention, a connecting linkage is linked to the sucker arrangement, for controlling the movement of the sucker arrangement, for example through the intermediary of a cam or curved path for controlling the connecting linkage.

According to yet another feature of the invention, this cam control is limited not only to returning or restoring the sucker arrangement to the starting position thereof, but also to controlling the entire movement sequence of the sucker arrangement. This provides accurate guidance of the sheet irrespective of the magnitude of the suction force or thickness of the sheet.

In accordance with another embodiment of the invention, the sucker arrangement comprises a plurality of individual suction cups which are juxtaposed and assigned to the trailing edge of the sheet. These suction cups may be attached individually; advantageously, they are mounted on a common cross-member which then performs the correcting movement.

In accordance with yet a further feature of the invention, the sucker arrangement comprises a suction bar. It is possible thereby to produce a very high holding force.

In accordance with an added feature of the invention, the transfer cylinder is disposed intermediate two other transfer drums and has a diameter double that of either of the two other transfer drums, and sucker arrangements are provided on the intermediate transfer cylinder and advantageously offset 180° from one another, the sucker arrangements being adjustable to the format of the sheet, each of the sucker arrangements being swivel-mounted.

In accordance with another aspect of the invention, there is provided a sheet transfer device for a printing machine with a transfer drum having a rotational axis, a sheet transfer cylinder located downstream from the transfer drum in a travel direction of a sheet through the printing machine, and cooperating with the transfer drum, and a gripper device on the sheet transfer cylinder for gripping at a take-over location a leading edge of the sheet guided by the transfer drum whereby the sheet is transferred to the sheet transfer cylinder, comprising a sucker arrangement including suction elements disposed on the transfer drum in vicinity of a trailing edge of the sheet guided by the transfer drum, the suction elements, in a starting position thereof, being flush with the periphery of the transfer drum, a suction-air control device actuable for supplying suction air to the suction elements so that suction contact may be made between the suction elements and the sheet, means for articulatingly linking the suction elements to the transfer drum so that the suction elements are changeable in position from the starting position thereof in a radial and tangential direction with respect to the transfer drum and beyond the periphery thereof into a swung-out position thereof, and resilient restoring means for returning the suction elements from the swung-out position thereof to the starting position thereof, the suction-air control device being actuable for continuously applying suction air to the suction elements, after the sheet has been gripped at the take-over location, for at least so long that the transfer drum has turned through a rotary angle which is greater by an angle $\alpha$ than an angle $\alpha_1$, included by the suction elements, on the one hand, and by the leading edge of the sheet, on the other hand, and having its vertex in the rotational axis of the transfer drum.

In accordance with another feature of the invention, the sheet transfer device includes a lever transmission for guiding the suction elements, including a first control lever rigidly connected to the suction elements and guided in a guide slot formed in the transfer drum, and a second control lever connected by an articulating joint to the first control lever, the resilient restoring means formed of a spring linked at one end to the transfer drum and at the other end to the lever transmission.

In accordance with a further feature of the invention, the suction elements are swingable out of the starting position thereof under the action of the suction contact between the suction elements, on the one hand, and the sheet, on the other hand, against the action of the resilient restoring means.

In accordance with an added feature of the invention, the first control lever has a first end by which the first control lever is guided in the guide slot, the suction elements being constrained to follow the movement of the first end of the first control lever, the second control lever having a first end by which the second control lever is connected by another articulating joint to the transfer drum, the first and the second control levers having respective second ends mutually connected by the first-mentioned articulating joint.

In accordance with an additional feature of the invention, the sheet transfer device includes a controlling connecting rod articulatingly connected to the first-mentioned articulating joint which mutually connects the first and the second control levers.

In accordance with yet another feature of the invention, the first control lever has a first and a second end, the first control lever being guided by the second end thereof in the guide slot, the suction elements being constrained to follow the movement of the first end of the first control lever, the second control lever connected by the articulating joint to the first control lever and forming a controlled connecting rod of the lever transmission system, the spring being a compression spring linked at the other end thereof to the second end of the first control lever.

In accordance with yet a further feature of the invention, the sucker arrangement comprises a plurality of the suction elements arranged in a row.

In accordance with yet an added feature of the invention, the suction elements are mounted on a cross-member.

In accordance with yet an additional feature of the invention, the sucker arrangement comprises a suction bar.

In accordance with another feature of the invention, the transfer drum has double the diameter of the sheet transfer cylinder, and another sheet transfer cylinder is located upstream from the transfer drum in the travel direction of the sheet, and including another sucker arrangement including suction elements disposed on the transfer drum in vicinity of a trailing edge of another sheet guided by the transfer drum, and the other sucker arrangement being offset 180° from the first-mentioned sucker arrangement.

In accordance with a concomitant feature of the invention the sheet transfer device includes means for adjusting the sucker arrangement to the format of the sheet.

Other features which are considered as characteristic for the invention are set forth in the appended claims.

Although the invention is illustrated and described herein as embodied in a sheet transfer device for a printing machine, it is nevertheless not intended to be limited to the details shown, since various modifications and structural changes may be made therein without departing from the spirit of the invention and within the scope and range of equivalents of the claims.

Figure 1A:
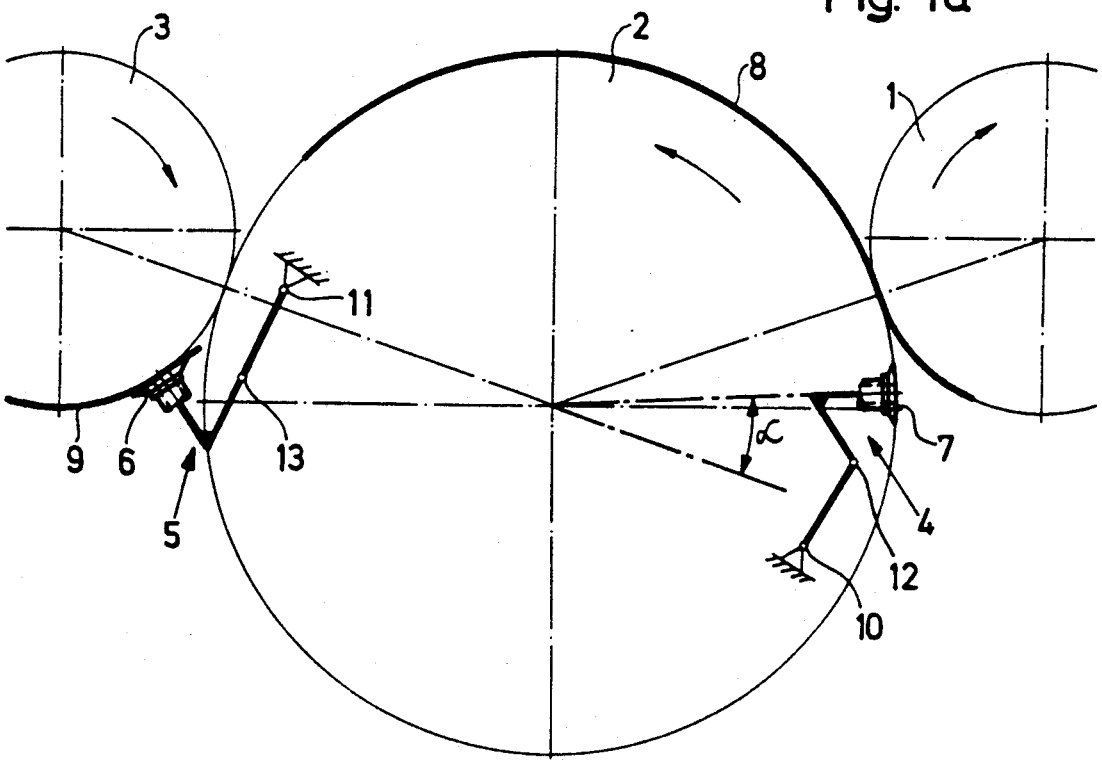
Figure 2:
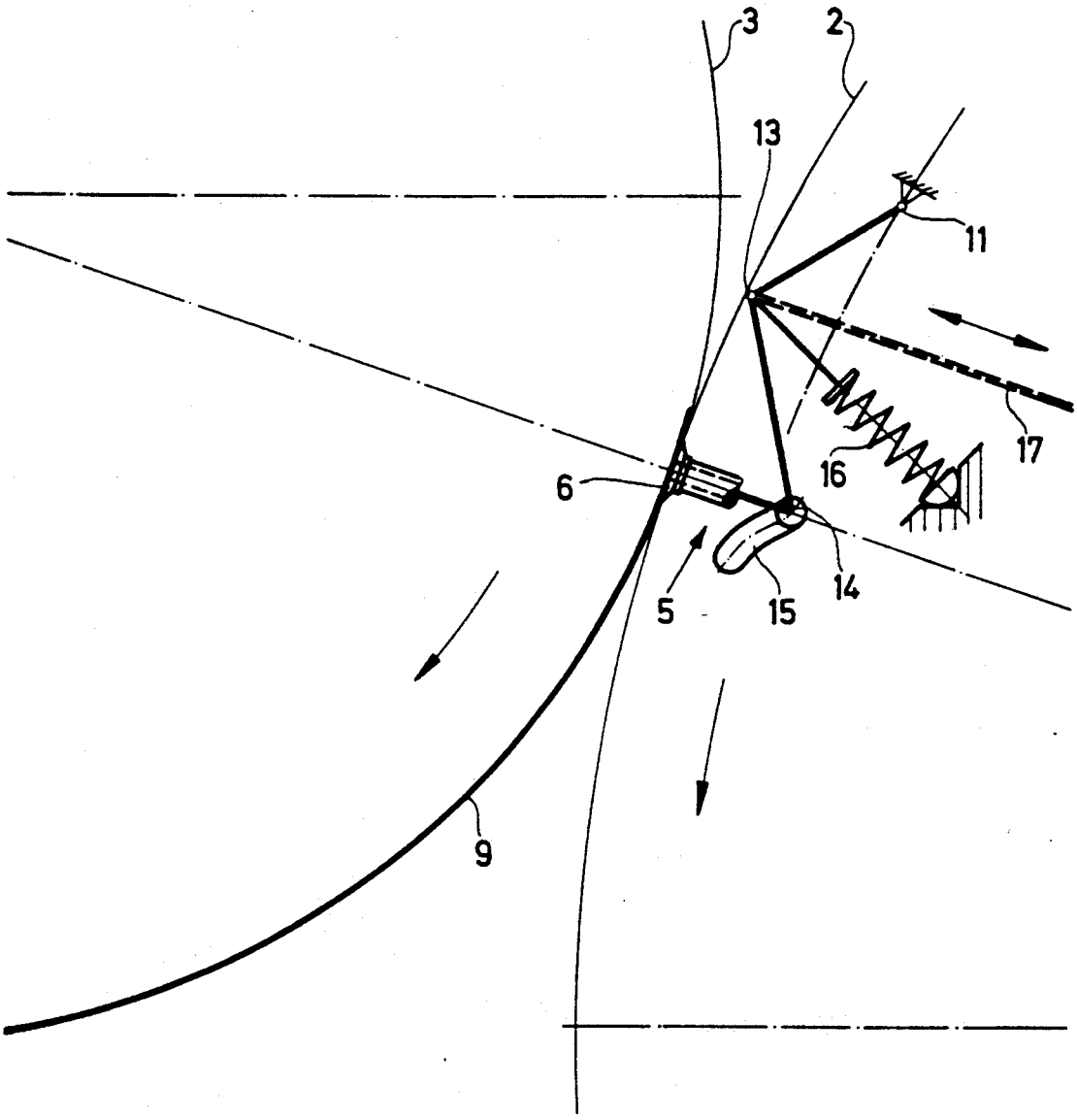
Figure 2A:
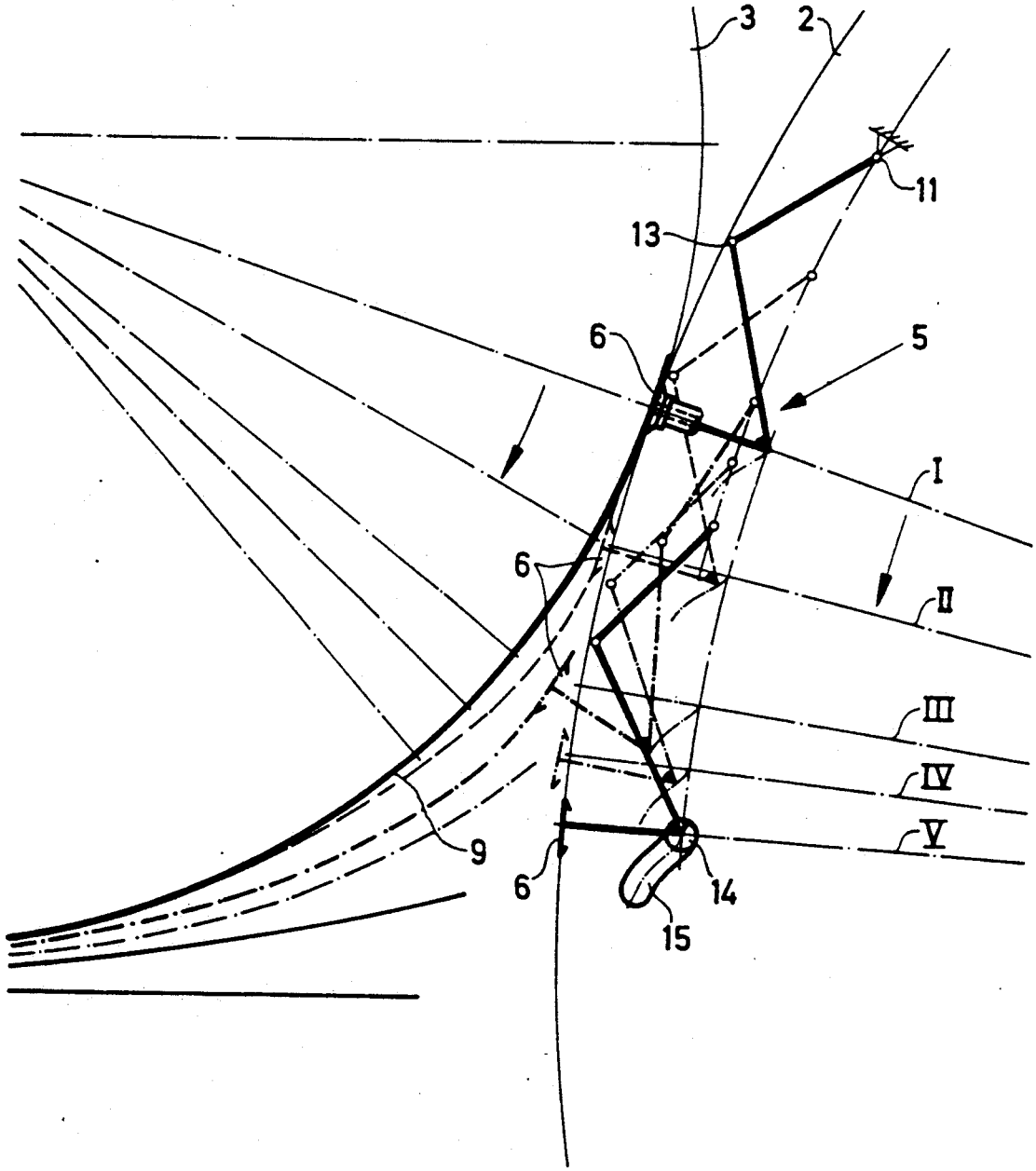
Figure 3:
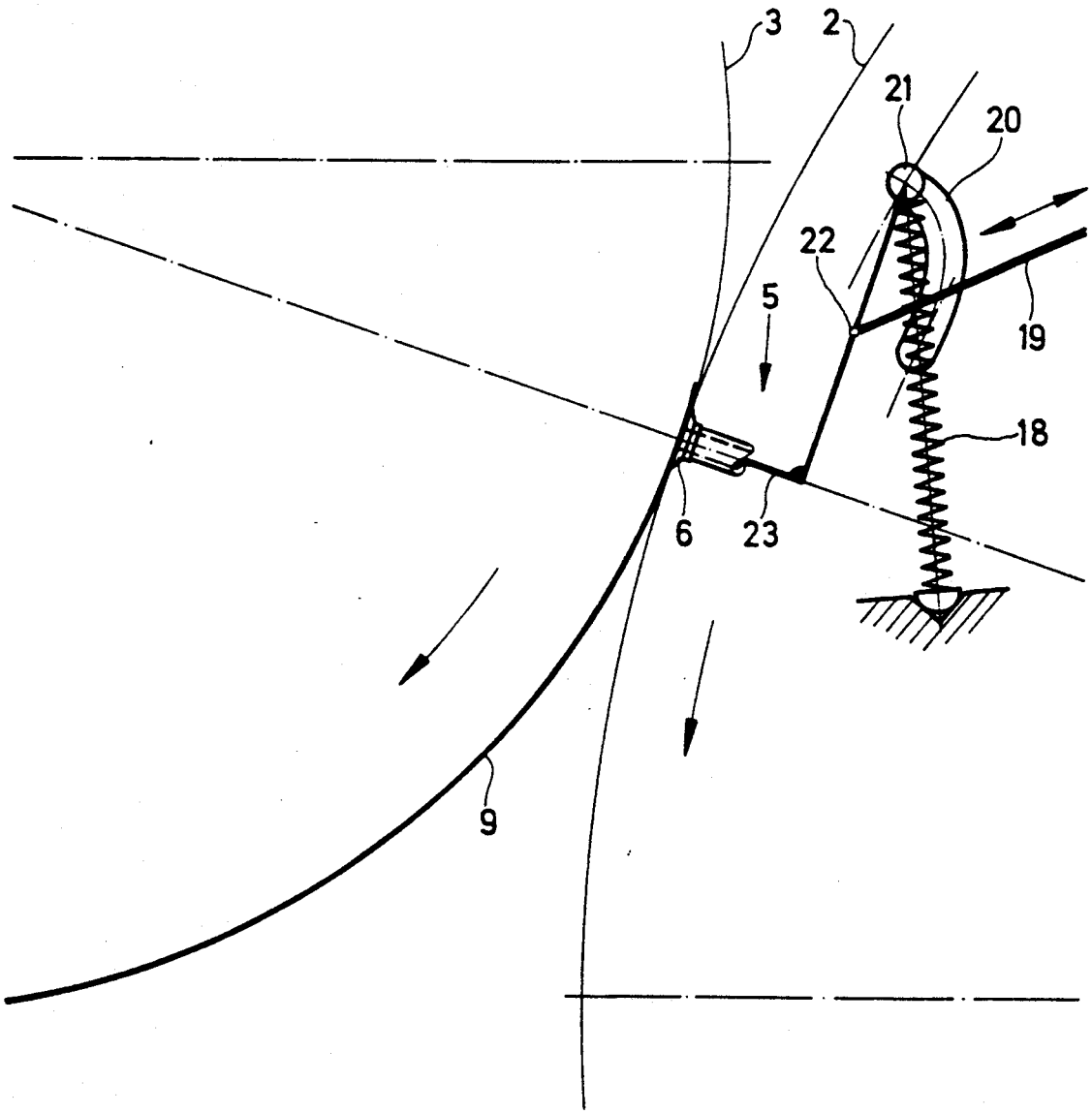
Figure 3A:
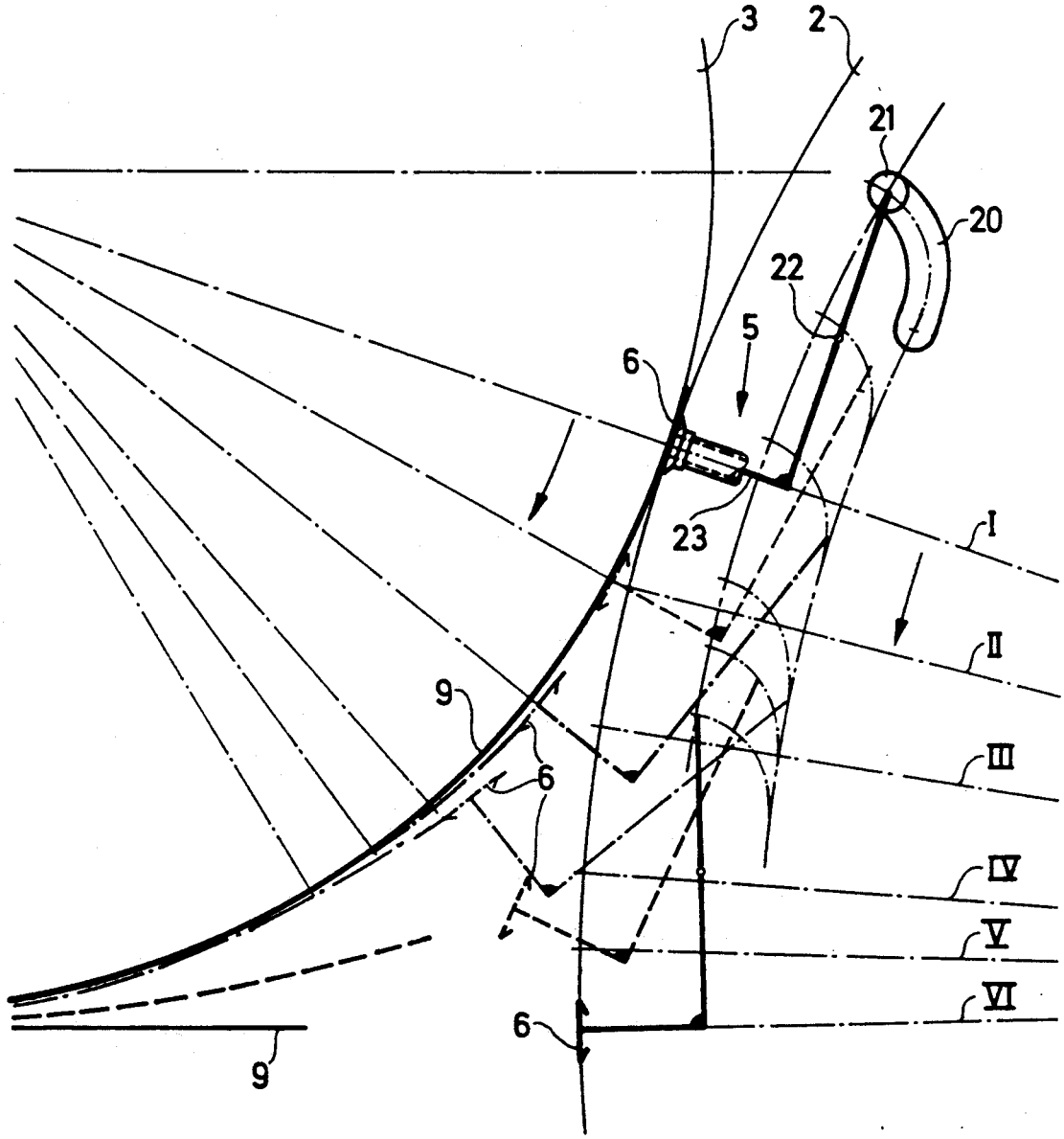

The construction and method of operation of the invention, however, together with additional objects and advantages thereof will be best understood from the following description of specific embodiments when read in connection with the accompanying drawings, in which:

FIG. 1. is a diagrammatic view of a sheet-transfer device with suction elements located in a starting position;

FIG. 1*a* is a view of the sheet-transfer device of FIG. 1 shown in another phase of operation thereof wherein a sucker arrangement forming part of the device is swung out;

FIG. 2 is an enlarged fragmentary view of FIG. 1 showing a first embodiment of the sucker arrangement according to the invention on a transfer drum;

FIG. 2*a* is another view of FIG. 2 showing a sequence of movement of the sucker arrangement in FIG. 2;

FIG. 3 is another view similar to that of FIG. 2 of a further embodiment of the sucker arrangement on the transfer drum; and FIG. 3*a* is another view of FIG. 3 showing a sequence of movement of the sucker arrangement in FIG. 3.

Referring now to the drawing and first, particularly, to FIG. 1 thereof, there is shown a sheet-transfer device, wherein a sheet 8, 9 especially is transferred by a transfer drum 2 to a succeeding sheet transfer cylinder 3. The transfer drum 2 is double the diameter of the succeeding transfer cylinder 3 and is provided with two sucker arrangements 4 and 5 evenly distributed over the circumference of the transfer drum 2 and extending parallel to the axis of rotation thereof. These sucker arrangements 4 and 5 serve to hold a trailing region of the sheet temporarily. For example, the sucker arrangements 4 and 5 prevent the sheets 8 and 9 from falling through the gap between the transfer drum 2 and the cylinder 3 during sheet transfer. This slipping-through or falling-forward of the sheet results usually in the smearing of the printed side of the sheet or even in damage to the sheet. The leading edge of the sheet is guided in a generally conventional manner, such as by means of grippers 30; a more detailed description is unnecessary. Respective suction elements 6 and 7 of each of the sucker arrangements 4 and 5 are guided by a lever transmission system. A respective lever transmission system includes a respective first control lever 24 and a second control lever 25. The control levers 25 are linked at respective first ends thereof to the transfer drum 2 at fastening points 10 and 11, respectively. The suction elements 6 and 7 are rigidly connected to a first end of the respective first control levers 24 which is guided by a guide slot formed in the transfer drum 2. A respective second end of the first control levers 24 and a respective second end of the second control levers 25 are mutually connected by a respective articulating joint 12, 13. In the illustrated embodiment of FIG. 1, the sucker arrangements are in their starting positions. In the instantaneous position of the transfer drum 2 shown in FIG. 1, the end of the sheet 8 has not yet reached the sucker arrangement 4, while the end of the sheet 9 is still held by the sucker arrangement 5.

FIG. 1*a* once again shows the arrangement according to FIG. 1, with the transfer drum 2 having in this case turned further through an angle with respect to the view of FIG. 1. The sucker arrangement 4 remains yet in its starting position, while the sucker arrangement 5 follows the end of the sheet 9 to the transfer drum 3. After the suction elements 6 have been vented by a non-illustrated suction-air control system, the sucker arrangement 5 releases the sheet 9 and returns to its starting position of FIG. 1.

With reference to the following FIGS. 2 and 3, the sequence of movement of the sucker arrangement is described in greater detail for two different embodiments.

According to FIG. 2, the sucker arrangement 5 is connected to the transfer drum 2 at the fastening point 11. The fastening joint 11 is a simple swivel joint, while the second fastening point of the sucker arrangement is a movable connecting link or crank 14 which can be displaced in a guide slot 15 firmly connected to or defined on the transfer drum 2. The curved shape of the guide slot 15 is selected so that the suction element 6 is able, within a given swivel range, to copy approximately the movement of the sheet end during transfer of the sheet to the succeeding transfer cylinder 3. In this embodiment of FIG. 1, the sequence of movement of the sucker arrangement 5 during transfer of the sheet is controlled by the sheet 9 itself, i.e. the sucker arrangement 5 is forcibly guided by the suction force between the sheet 9 and the suction element 6. The return of the sucker arrangement 5 to its starting position is effected by a compression spring 16, which is mounted or held by one end thereof on the transfer drum 2 and by tghe other end at the joint 13. The force of the spring is such that it, on the one hand, is able to return the sucker arrangement 5 to its starting position and, on the other hand, does not exert excessive tensile forces via the suction force onto the sheet 9. The control of the movement of the sucker arrangement by means of the sheet 9 and the suction force, respectively, can also be replaced by the control of its movement by a connecting rod 17. This is indicated only by broken lines in FIG. 2 and is explained further hereinbelow with reference to FIG. 3.

FIG. 2*a* shows, in phases I to V, the sequence of movement of the sucker arrangement 5 shown in FIG. 2. In phase I, the suction element 6 is still in its starting position; the end of the sheet 9 is thus still in contact with the transfer drum 2. In phase II, the connecting link or crank 14 of the sucker arrangement has moved a relatively short distance in the guide slot 15; thus, the suction element 6 has moved outwardly from its starting position both in the radial direction and in the circumferential direction out of the periphery of the transfer drum 2. The end of the sheet is then located between the transfer drum 2 and the cylinder 3 In phase III, the crank or coulisse 14 has reached the end of the guide slot 15. The suction element 6 is in the outermost end position; The sheet 9 or the end of the sheet 9 is released thereat from the suction element 6. Owing to the internal stresses in the sheet 9, the end of the sheet then moves downwardly, but cannot touch any part of the transfer drum 2 and can thus not be damaged. As shown in phases IV and V, the sucker arrangement 5 returns to its starting position.

Another embodiment of the sucker arrangement 5 according to the invention is shown on the transfer drum 2 in FIG. 3. The suction element 6 is, in this regard, rigidly connected to a first end of a first control lever 23. The second end of the first control lever 23 is guided by a crank or coulisse 21 in a guide slot 20 of the transfer drum 2. A controlled connecting rod 19 is provided as a second control lever which is articulatingly connected at an articulating joint 22 with the first control lever 23. A compression spring 18, which is linked at one end to the transfer drum 2 and, at the other end, to the coulisse or crank 21, ensures the return of the suction arrangement to the starting position thereof.

With reference to FIG. 3*a*, the sequence of movement of the sucker arrangement 5 shown in FIG. 3 is described hereinafter in phases I–VI. In the interest of clarity, the connecting rod 19 and the compression spring 18 have been omitted in FIG. 3*a*.

In FIG. 3*a*, Phase I shows the rubber sucker 6 at the "point of contact" of the transfer drum 2 with the cylinder 3. In this position, the sucker arrangement 5 is still in its starting position.

In Phase II, owing to the longitudinal movement of the connecting rod, the sucker arrangement with the suction element 6 has moved outwardly in radial direction. At the same time, the suction element 6 is tilted by the curved guide slot 20 in which the crank or coulisse 21 has likewise travelled a given distance due to the movement of the connecting rod. The extent of tilting is such that the end of the sheet 9 is matched to the radius of the succeeding cylinder 3.

Phase III shows the sucker arrangement 5 near its end position, which is reached finally in phase IV. It is there that the suction air is switched off. Thus the sheet 9 is able to slide off the suction element 6. At the same time, the operation for returning the sucker arrangement 5 to the starting position is initiated. The return movement of the sucker arrangement 5 is effected at a higher speed than that of the correcting movement. This ensures that the sheet end does not execute any sliding-off movement on the sucker arrangement 5. When moving downwardly due to internal relaxation of stress, the end of the sheet can neither touch the second transfer cylinder 2 nor the suction element 6. The suction element 6 cannot, therefore, be damaged; furthermore, sure and smooth travel of the sheet is assured. Although FIGS. 1 to 3 show in each case only one suction element in the sucker arrangements, it is readily apparent that the end of the sheet is held by a row of suction elements which are provided in accordance with the width of the sheet.

We claim:

1. Sheet transfer device for a printing machine with a transfer drum having a rotational axis, a sheet transfer cylinder located downstream from the transfer drum in a travel direction of a sheet through the printing machine, and cooperating with the transfer drum, and a gripper device on the sheet transfer cylinder for gripping at a take-over location a leading edge of the sheet guided by the transfer drum whereby the sheet is transferred to the sheet transfer cylinder, comprising a sucker arrangement including suction elements disposed on the transfer drum in vicinity of a trailing edge of the sheet guided by the transfer drum, said suction elements, in a starting position thereof, being flush with the periphery of the transfer drum, a suction-air control device actuable for supplying suction air to said suction elements so that suction contact may be made between said suction elements and the sheet, means for articulatingly linking said suction elements to the transfer drum so that said suction elements are changeable in position from the starting position thereof in a radial and tangential direction with respect to the transfer drum and beyond the periphery thereof into a swung-out position thereof, and resilient restoring means for returning said suction elements from said swung-out position thereof to the starting position thereof, said suction-air control device being actuable for continuously applying suction air to said suction elements, after the sheet has been gripped at the take-over location, for at least so long that the transfer drum has turned through a rotary angle which is greater by an angle $\alpha$ than an angle $\alpha_1$, included by said suction elements, on the one hand, and by the leading edge of the sheet, on the other hand, and having its vertex in the rotational axis of the transfer drum.

2. Sheet transfer device according to claim 1, including a lever transmission for guiding said suction elements, including a first control lever rigidly connected to said suction elements and guided in a guide slot formed in the transfer drum, and a second control lever connected by an articulating joint to said first control lever, said resilient restoring means formed of a spring linked at one end to the transfer drum and at the other end to said lever transmission.

3. Sheet transfer device according to claim 2, wherein said suction elements are swingable out of the starting position thereof under the action of the suction contact between said suction elements, on the one hand, and the sheet, on the other hand, against the action of said resilient restoring means.

4. Sheet transfer device according to claim 2, wherein said first control lever has a first end by which said first control lever is guided in said guide slot, said suction elements being constrained to follow the movement of said first end of said first control lever, said second control lever having a first end by which said second control lever is connected by another articulating joint to the transfer drum, said first and said second control levers having respective second ends mutually connected by the first-mentioned articulating joint.

5. Sheet transfer device according to claim 4, including a controlling connecting rod articulatingly connected to said first-mentioned articulating joint which mutually connects said first and said second control levers.

6. Sheet transfer device according to claim 2 wherein said first control lever has a first and a second end, said first control lever being guided by said second end thereof in said guide slot, said suction elements being constrained to follow the movement of said first end of said first control lever, said second control lever connected by said articulating joint to said first control lever and forming a controlled connecting rod of said lever transmission, said spring being a compression spring linked at said other end thereof to said second end of said first control lever.

7. Sheet transfer device according to claim 1, wherein said sucker arrangement comprises a plurality of said suction elements arranged in a row.

8. Sheet transfer device according to claim 1, wherein said suction elements are mounted on a cross-member.

9. Sheet transfer device according to claim 1, wherein said sucker arrangement comprises a suction bar.

10. Sheet transfer device according to claim 1, wherein the transfer drum has double the diameter of the sheet transfer cylinder, and another sheet transfer cylinder is located upstream from the transfer drum in the travel direction of the sheet, and including another sucker arrangement including suction elements disposed on the transfer drum in vicinity of a trailing edge of another sheet guided by the transfer drum, and said other sucker arrangement being offset 180° from the first-mentioned sucker arrangement.

11. Sheet transfer device according to claim 1, including means for adjusting said sucker arrangement to the format of the sheet.

* * * * *